US008937444B2

(12) United States Patent
Ogg et al.

(10) Patent No.: US 8,937,444 B2
(45) Date of Patent: Jan. 20, 2015

(54) REMOTE LIGHTING CONTROL

(75) Inventors: Felix Henric Govert Ogg, Eindhoven (NL); Gerardus Antonius Maria Bagen, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 1394 days.

(21) Appl. No.: 12/600,015

(22) PCT Filed: May 9, 2008

(86) PCT No.: PCT/IB2008/051846

§ 371 (c)(1), (2), (4) Date: Jul. 22, 2011

(87) PCT Pub. No.: WO2008/142603

PCT Pub. Date: Nov. 27, 2008

(65) Prior Publication Data

US 2011/0273114 A1 Nov. 10, 2011

(30) Foreign Application Priority Data

May 22, 2007 (EP) ..... 07108684

(51) Int. Cl.
*H05B 37/02* (2006.01)

(52) U.S. Cl.
CPC ..... *H05B 37/0245* (2013.01); *H05B 37/029* (2013.01)
USPC ..... 315/307; 315/292; 315/294; 315/312; 315/316

(58) Field of Classification Search
CPC ..... H05B 33/0863; H05B 33/0842; H05B 37/0245; H05B 37/029; H05B 37/02; G02B 27/024; G02B 27/026
USPC ..... 315/292, 294, 207, 307, 308, 312, 316, 315/318; 345/204, 207, 581, 594, 520, 530, 345/690; 362/27, 764, 779, 788
See application file for complete search history.

(56) References Cited

U.S. PATENT DOCUMENTS

| | | | |
|---|---|---|---|
| 5,031,082 | A | 7/1991 | Bierend |
| 5,061,997 | A | 10/1991 | Rea et al. |
| 5,550,726 | A | 8/1996 | Hiromachi et al. |

(Continued)

FOREIGN PATENT DOCUMENTS

| | | | |
|---|---|---|---|
| JP | 0745370 | A | 2/1995 |
| JP | 2000277268 | A | 10/2000 |

(Continued)

*Primary Examiner* — Haiss Philogene
(74) *Attorney, Agent, or Firm* — Meenakshy Chakravorty

(57) ABSTRACT

A lighting system (100) includes light sources (110) and a user interface (130) configured to display an image of an environment including an object provided with a first illumination. The image may be provided by a camera (140) to a remote display device (260). A processor (120) may be configured to change the first illumination to a second illumination in response to a signal and to select at least one of the light sources to provide the second illumination based on attributes of the second illumination and availability and specifications of the light sources. The signal may be provided by a user viewing the image. Alternatively or in addition, the processor (120) may be further configured to generate the signal by detecting a change of the object using content analysis of the image in comparison with a previous image.

7 Claims, 2 Drawing Sheets

(56) References Cited

U.S. PATENT DOCUMENTS

| | | | | |
|---|---|---|---|---|
| 6,269,565 | B1 * | 8/2001 | Inbar et al. | 40/361 |
| 6,624,597 | B2 | 9/2003 | Dowling et al. | |
| 6,714,594 | B2 | 3/2004 | Dimitrova et al. | |
| 6,984,043 | B2 * | 1/2006 | Nakamura et al. | 353/94 |
| 7,202,613 | B2 * | 4/2007 | Morgan et al. | 315/312 |
| 7,202,838 | B2 * | 4/2007 | Kerr et al. | 345/1.2 |
| 2003/0057887 | A1 * | 3/2003 | Dowling et al. | 315/291 |
| 2004/0148632 | A1 | 7/2004 | Park et al. | |
| 2004/0168205 | A1 | 8/2004 | Nesvadba et al. | |
| 2004/0178750 | A1 | 9/2004 | Belliveau | |

FOREIGN PATENT DOCUMENTS

| | | | |
|---|---|---|---|
| WO | 9408437 | A1 | 4/1994 |
| WO | 9837737 | A1 | 8/1998 |
| WO | 2008038188 | A2 | 4/2008 |

* cited by examiner

REMOTE LIGHTING CONTROL

FIELD OF THE INVENTION

The present system relates to a lighting system configured to control and change illumination provided by desired light sources manually and/or automatically upon detection of change in the environment.

Lighting systems enables a particular space, such as an office or a shop or any private or public place, etc., to become a more natural environment by creating lighting conditions familiar and attractive to people. This is especially beneficial in environments that are relatively closed and/or windowless, such as shops, shopping malls, meeting rooms and cubicle offices.

BACKGROUND OF THE INVENTION

Conventional lighting systems allow control of light sources, such as dimming, switching on/off and color adjustments in order to provide an enriching experience and improve productivity, safety, efficiency and relaxation. Conventional illumination control systems are described in PCT Publication No. WO 98/37737 to Kier and U.S. Pat. No. 5,061,997 to Rea, each of which is incorporated herein by reference in its entirety.

Shop lighting is generally designed and installed for shops selling a variety of goods such as fashion clothes stores. Typically, spotlights in a fashion store are aimed to create carefully designed atmosphere to encourage shopping, to emphasize certain goods, to make the interior look interesting/appealing, etc. However, in most cases, the lighting design is done once, e.g., upon installation of a lighting system, renovation or the like, and often remains unchanged, at least until a light designer returns after a long period of time, such as after a period of a year or so, to adjust spotlights to complement new interior changes.

Additionally, shop personnel are not trained to assess lighting conditions and often do not have time to design the lighting. Merchandisers who create product displays are often not allowed to "touch" or change the lighting system. Hence, in most shops, the lighting is left unchanged while the interior changes such as with the arrival of new goods which are displayed and arranged in a manner which is different than the previous arrangement. Often, the unchanged lighting design does not complement the changed environment or location of the displayed goods resulting in a lighting atmosphere that degrades with every change of the interior because most shops (e.g. fashion stores) change their interior several times a year.

Accordingly, there is a need for a lighting control system which is cost effective and allows for change of illumination efficiently.

SUMMARY OF THE INVENTION

One object of the present systems and methods is to overcome the disadvantages of conventional control systems.

According to illustrative embodiments, a lighting system comprises light sources and a user interface configured to display an image of an environment including an object provided with a first illumination. The image may be provided by a camera to a remote display device. A processor may be configured to change the first illumination to a second illumination in response to a signal and to select at least one of the light sources to provide the second illumination based on attributes of the second illumination and availability and specifications of the light sources. The signal may be provided by a user viewing the image. It may be especially suitable for the user to compare the current image with a previous image and to provide the signal by detecting a change of the object. Alternatively or in addition, the processor may be further configured to generate the signal by detecting a change of the object using content analysis of the image in comparison with a previous image. Additionally, the processor may be configured to return to the first illumination settings based on an image of said first illumination.

Further areas of applicability of the present systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

BRIEF DESCRIPTION OF THE DRAWINGS

These and other features, aspects, and advantages of the apparatus, systems and methods of the present invention will become better understood from the following description, appended claims, and accompanying drawing where:

DETAILED DESCRIPTION OF THE EMBODIMENT

The following description of certain exemplary embodiments is merely exemplary in nature and is in no way intended to limit the invention, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 1:
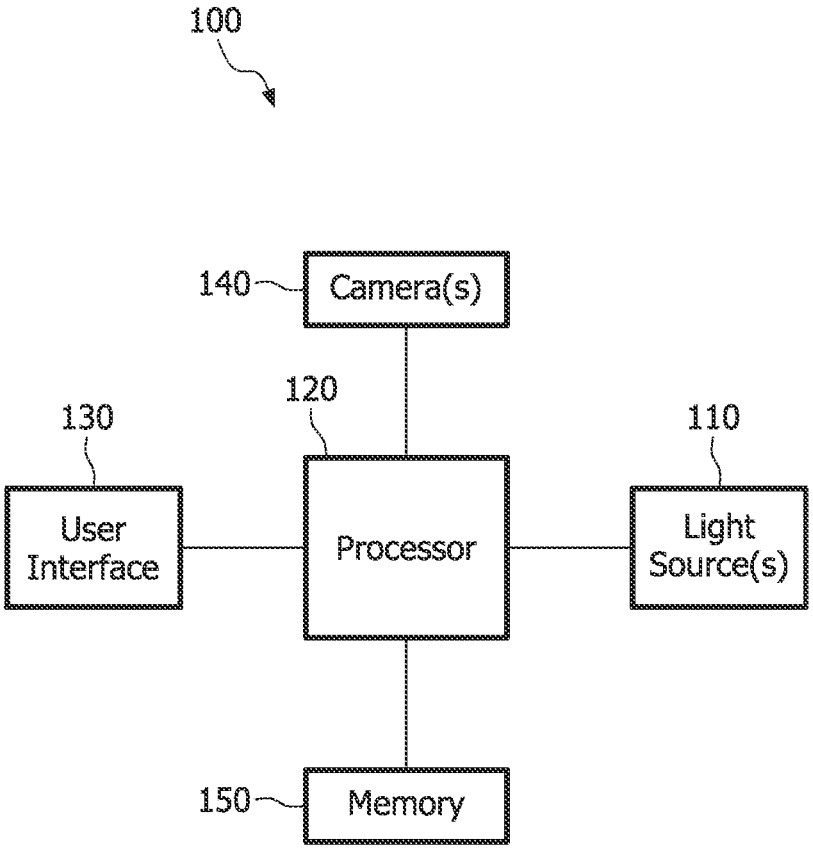
FIG. 1 shows a lighting control system according to one embodiment.

FIG. 1 shows one embodiment of a block diagram of a lighting interaction or control system 100 that includes at least one controllable light source 110 operationally coupled to a processor 120. The processor 120 is operationally coupled to a user interface 130, at least one camera(s) 140 and a memory 150 which stores application programs and data for execution and processing by the processor 120. The processor 120 and memory 150 may be centralized or distributed among the various system components.

Typically, cameras are prevalent throughout an environment such as a retail store, for example, to monitor shoppers, employees and observe the state of the shop floor. Of course, light sources are also typically included in various environment or locations such as retail stores. Accordingly, the present system may use existing hardware to minimize cost and provide a cost effective lighting control system.

The lights source(s) 110 may be light emitting diodes (LEDs) since they are particularly well suited light sources to controllably provide light of varying attributes, as LEDs may easily be configured to provide light with changing colors, intensity, hue, beam shape, saturation, beamshape and other attributes, and typically have electronic drive circuitry for control and adjustment of the various light attributes. However, any controllable light source may be used that is capable of providing lights of various attributes, such as various intensity levels, different colors, hues, saturation and the like, such as incandescent, fluorescent, halogen, or high intensity discharge (HID) light, LEDs and the like, which may have a ballast or drivers for control of the various light attributes.

Additional controlled elements may also be provided for monitor and light control, such as motors under the control of the processor 120 to change direction of the light sources 110 and/or camera(s) 140. The motors may also control a beam width of the light source(s) via controllable diffuser, for example, and thus the direction and width of the light emanating therefrom. Further, the processor or controller 120 (which may be a personal computer, for example) may also be configured to control the user interface to provide real time feedback, such as visual feedback using the cameras 140, of the current illumination and/or light settings of the light interaction system 100.

The user interface 130 may be provided at a location remote from the camera (or retail store) location, for example, and comprises a display for displaying images captured and provided by the camera(s) 140. Further, the user interface 130 also include a user input device, such as joy stick, a keyboard, mouse or pointer in the case the display is a touch sensitive display. The joy stick may be used to control the motorized lamps 110 and/or cameras 140, for remote aiming based on view(s) or image(s) of the store displayed on the display provided from the controllable camera(s) 140.

Accordingly, the present system enables a professional light designer, located at a remote location from a store, to monitor and readjust the lighting conditions in the store to fit a desired design and illumination, given the new interior or change of environment, such as displaying different merchandise at different location of the store, and the like. The light designer may remotely control the light sources and obtain desired images by remotely controlling the camera to view the current store environment and change the illumination as desired, such as illuminating new merchandize with various types of illumination, providing desired background or accented illumination and the like.

The various elements and components of the control system 100 may be interconnected through a bus, for example, or operationally coupled to each other via any link, such as wired or wireless, using various protocols such as ZigBee™, DMX™ and/or Bluetooth™, to control the light sources 110 and/or cameras 140, for example, including through a network(s), local or wide area networks such as the Internet (e.g., via a dial-in or broadband modems), for remote monitoring, communication and control. Thus, the user such as a professional light designer may be located far away from the illumination area, e.g., retail store, and may access and view the lighting area via Internet or by another means, as well as control the light sources 110 and cameras 140.

The processor 120 may be configured to receive manual input from the user interface 130, and in response, determine and select a proper light source(s) based on the desired illumination and location to be illuminated (e.g., manually provided by the user through the user interface 130). The selection of the light source(s) is further based on availability and specifications of the light sources. For example, if a red light is desired, then only lights capable of producing red lights are considered for selections based on the specifications of the light sources, for example, where the specification include capabilities of the light source such as the type of light or light attributes that may be obtained from the light source, such as the type of colors, powers, intensities, focus, diffuseness, saturation, directivity, beam width and the like. Further, if a light source is already being used to provide illumination, then it may be considered unavailable or may still be considered as a candidate light source to provide the desired illumination if impact on the current lighting condition is minimal, such as when two light sources are providing similar light to similar locations and thus using only one light source (and diverting the other light source) will not have a major impact on the current lighting conditions. Upon identification and selection, the proper light source(s) is controlled by the processor 120 to illuminate the desired location/object with the desired illumination.

Illustratively, the user interface may be configured to display on a screen a location or locations desired to be lit in a particular manner, and allow users to select desired illumination attributes or change at least one of a group of lighting attributes for a selected portion or portions of the location. The illumination attributes may include light source location (or light source position), light source direction, intensity, color, color temperature, hue, diffuseness, beam width, focus, chromaticity, luminance and saturation.

Figure 2:
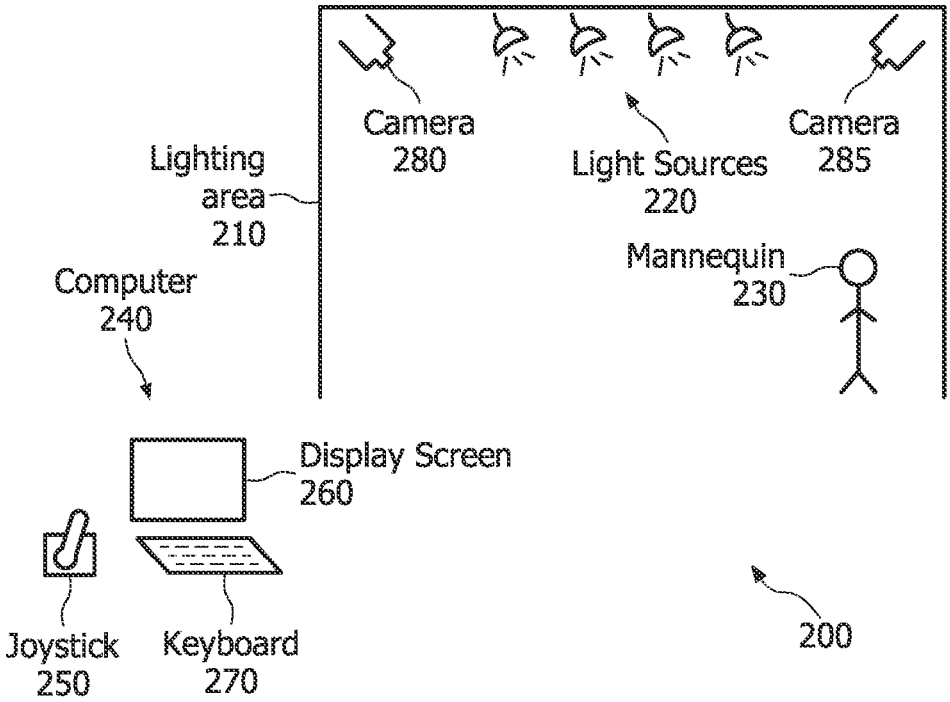
FIG. 2 shows a lighting control system controlling multiple light sources in a room via a control interface according to another embodiment.

FIG. 2 shows a light control system 200 for illuminating a lighting area 210 with light sources 220, such as illuminating a mannequin 230 or any other object included in the lighting area or environment 210. The control system 200 comprises a computer 240 such as a personal computer (PC), joystick 250, display screen 260 and keyboard 270. The computer 240 may be configured to receive video images of the lighting area 210 through cameras 280, 285 for display on the screen 260 to allow a user, such as a lighting designer to observe the lighting area 210 on the display screen 260. The control system 200 allows the lighting designer to control the cameras 280, 285 and the light sources 220 by manipulating a joystick, keyboard, mouse, pointer, or by another input or controlling device, to obtain a desired view of the lighting area 210 on the display screen 260, and control the light sources 220 to provide illumination of a desired portion of the lighting area 210 (such as the mannequin 230) with desired light attributes.

In a manual mode, the lighting designer may look into the store by browsing the different camera views. If the designer notices one of the light sources 220 or spotlights needs to be re-adjusted, the designer may choose the camera view that shows the effects, e.g., by remotely controlling at least one of the cameras 280, 285. The designer may select at least one the controllable lamps 220 that render light into that view, and may control each one of the lamps with the joystick or by some other controlling device. Furthermore, the designer may change any desired light attributes such as light intensity, color, color temperature, hue, diffuseness, focus, beam width, direction, chromaticity, luminance and saturation.

In a semi-automatic mode, the user or lighting designer may, via the user interface, such as pointing at a portion of the image of the lighting area 210 displayed on the screen 260, select the portion of the lighting area 210, via a mouse click or by tapping the screen 260 with a pointer in the case of a touch sensitive screen. In addition to selecting the desired lighting area portion or object to be illuminated, the lighting designer may also chose the desired light attributes, such as from menus or lists displayed on the screen 260, for example.

In response to user selection of desired object to be illuminated and light attributes, the computer 240 (or processor 120 of FIG. 1) may be configured to determine and select the proper light sources from the available light sources, as well as re-assign or re-deploy light sources as necessary. For example, if there are only two light sources capable of providing red light and both are illumination the left corner of the lighting area or room 210, and the user or lighting designer requests that the mannequin 230 at the right corner of the room 210 be illuminated, then the processor polls the unused light sources and determines that none of them can provide the desired illumination (e.g., red light) at the desired location (e.g., right corner of room to illuminate the mannequin 230). The processor may be further configured to poll the used light sources and determine that one of the two red light source illuminating the left corner may be used to illuminate the right corner or mannequin 230, and automatically control one of the red light sources to illuminate the right corner or mannequin 230.

Of course, prior to any diversion of used resources such as the used red light source(s), the processor may also be configured to present the user with a request to acknowledge diversion of one of the red light sources from illuminating the left corner to illuminating the right corner or mannequin 230. Further user indication may also be provided, such as a message that informs the user of the need for additional light sources at certain location(s) in the room to produce the desired light condition, in view of existing resources and utilization, for example. The light system may indicate such messages or indications via a dialogue box displayed on the screen 260, which may be accompanied by further information such as a map of existing light sources and system capabilities, including portion of the lighting area that are capable of being illuminated by light of certain attributes and the like.

Thus, the processor may be configured to automatically determine which light source(s) to control in order to provide the desired illumination while minimizing impact on the existing lighting conditions. Accordingly, the lighting system may determine at each request how to best utilize, select and control the existing light sources to display the required lighting condition(s).

Figure 3:
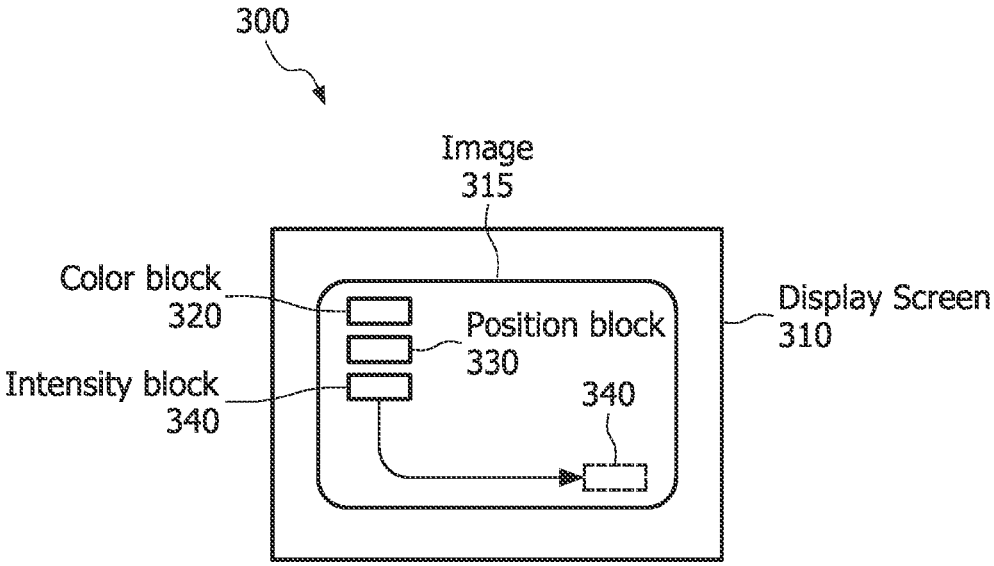
FIG. 3 shows an embodiment of a user interface.

FIG. 3 shows a user interface 300 comprising display screen 310, and light effect boxes 320, 330, 340. The display 310 may show an image 315 of the lighting area 210 shown in FIG. 2, for example, via a video camera placed in the lighting area. The display 310 may be a digitized image of the lighting area 210 or some other representation of the lighting area. The light effect blocks 320 (light color), 330 (light position or direction) and 340 (light intensity) are tools that are configured to change the light color, position, intensity. Of course, further boxes may be associated with further light attributes such as beam shape, hue, saturation, and the like.

In use, the light intensity block 340 may be moved and placed over a portion of the displayed image 315 of the lighting area 210 and the light intensity may be specified for that area as shown by the dashed box 340'. The lighting system may then change the intensity light provided from the light source(s) to illuminate the room location associated with the displayed location of the moved box 340' to match the specified intensity associated with box 340'. Of course, the system or processor may be configured provide further controls as necessary, such as moving or pointing the light source(s) toward the room location associated with box 340'. Other light attribute blocks may be moved or dragged to various portions of the displayed image 315 to provide associated illumination at the respective locations. For example, the light color block 320, when moved to a portion of the displayed image 315, may control the color of light provided from light source(s) and directed to a room location associated with the moved location of the color block 320.

A map of the location being illuminated may be displayed on the user interface. A real-time video of the area, provided by camera, may also be displayed on the user interface.

The user interface may have different methods to control the lighting system such as moving different boxes or bars to different image display portions associated with the actual location being illuminated. These different boxes or bars may represent different light attributes such as intensity, color, color temperature, saturation, etc. As described, when different boxes are moved to different areas of the screen/location, processor may be configured to determine and select light sources, including diversion of change of currently used light sources to provide the desired illumination while minimizing impact of the initial light conditions. Of course, in another mode, the processor may be configured to only use available light sources, and not change currently used light sources.

In yet another automatic environment, the controller 120 shown in FIG. 1 may be configured to automatically detect changes in the environment, such as change of mannequin position, via floor pressure sensors, motion sensors and/or content analysis of a current image as compared to a previous image to determine scene images in the desired area of illumination. Content analysis and detection of character, images and/or scene changes are well known, such as described in U.S. Pat. No. 6,714,594 to Dimitrova, and U.S. Patent Application Publication No. 2004/0168205 to Nesvadba, each of which is incorporated herein by reference in its entirety. Thus, based on detection of a scene change, such as a change in the position of the mannequin 230 shown in FIG. 2, the controller 120 may be configured to control the light sources to illuminate the mannequin 230 at its new location, for example, with the same or different light attributes of illumination provided from the same or different light source(s).

Motion sensors may also be provided to detect customers approaching an area, such as the mannequin 230, and in response to such detection, the processor may be configured to change one or more light attributes of light illuminating the mannequin 230, such as changing the color, intensity, or pulsating the light on/off, and the like. For example, a motion sensor may detect a customer walking by a display of products in a retail shop, and the motion of the customer may trigger the light sources illuminating the display or goods to change intensity, color, or another light effect of the lighting system. The customers' motion may trigger other light effects such as rotating certain objects such as the mannequin or products being displayed or changing lights or colors.

Assignment of lamps to views may be done statically, or it may be performed automatically as described in European Patent Application Serial No. EP 06121484.7, filed on Sep. 29, 2006 and entitled "Method and Device for Composing a Lighting Atmosphere from an Abstract Description and Lighting Atmosphere Composition System."

The present systems and methods provide a cost effective update of lighting conditions since, for example, highly paid shop lighting designers need not be physically present at the location each time there is a change in the décor or shop environment. The present lighting systems and methods may enable designers to provide after-sales-service, such as in the form of a subscription/pay-per-update service. Since the light design service involves no traveling costs, it may be offered at a more affordable price. For shop owners, the remote control of light sources may be quite desirable since many shop owners themselves are asking the lighting industry for motorized lamp products.

Motorized lamps may be aimed remotely, based on a view or image of the store displayed on a remote screen and provided from a controllable camera (may be motorized as well) located at the store. A lighting system that couples a view of the lamp's effect to the control of the camera enables a professional (light designer) to re-adjust the lighting conditions in a store to fit the original design, given the new interior design or decor.

It should also be understood that many controllable light sources may be provided which may be individually or collectively controlled in groups or sub-groups to provide a desired illumination, which may manually, semi-automatically or automatically be changed.

Of course, as it would be apparent to one skilled in the art of communication in view of the present description, various elements may be included in the system or network components for communication, such as transmitters, receivers, or transceivers, antennas, modulators, demodulators, converters, duplexers, filters, multiplexers etc. The communication or links among the various system components may be by any means, such as wired or wireless for example. The system elements may be separate or integrated together, such as with the processor. As is well-known, the processor executes instruction stored in the memory, for example, which may also store other data, such as predetermined or programmable settings related to system control. Further, the processor may be configured to learn from user actions and history of interactions to propose lighting changes to the user and/or to automatically control the light sources to provide changed illumination based on detection of a change in the environment and/or history of user interactions or rules programmed and provided by the user, for example, and stored in the memory.

Various modifications may also be provided as recognized by those skilled in the art in view of the description herein. The operational acts of the present methods are particularly suited to be carried out by computer software. The application data and other data are received by the controller or processor for configuring it to perform operation acts in accordance with the present systems and methods. Such software, application data as well as other data may of course be embodied in a computer-readable medium, such as an integrated chip, a peripheral device or memory, such as the memory 150 shown in FIG. 1 or other memory coupled to the processor.

The computer-readable medium and/or memory may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory.

Additional memories may also be used. The computer-readable medium, the memory, and/or any other memories may be long-term, short-term, or a combination of long-and-short term memories. These memories configure the processor/controller to implement the methods, operational acts, and functions disclosed herein. The memories may be distributed or local and the processor, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network, such as the Internet, is still within memory, for instance, because the processor may retrieve the information from the network.

The controllers/processors and the memories may be any type. The processor may be capable of performing the various described operations and executing instructions stored in the memory. The processor may be an application-specific or general-use integrated circuit(s). Further, the processor may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for remote controlling of light sources may be utilized in conjunction with further systems.

Of course, it is to be appreciated that any one of the above embodiments or processes may be combined with one or with one or more other embodiments or processes to provide even further improvements in remote lighting control.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same or different item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

The invention claimed is:

1. A lighting system comprising:

a plurality of light sources;

a user interface configured to display an image of an environment including an object provided with a first illumination; and a processor configured to generate a signal by detecting a change in the appearance of the object using content analysis of the image in comparison with a previous image and to change the first illumination to a second illumination in response to the signal and to select at least one of the plurality of light sources to provide the second illumination based at least in part on attributes of the second illumination and availability and specifications of the light sources.

2. The lighting system of claim 1, further comprising a camera configured to monitor the environment and provide the image.

3. A method of controlling a lighting system including light sources comprising:

displaying an image of an environment including an object provided with a first illumination;

changing the first illumination to a second illumination in response to a signal and to select at least one of the light sources to provide the second illumination based on attributes of the second illumination and availability and specifications of the light sources; and detecting a change of the object using content analysis of the image in comparison with a previous image to generate the signal.

4. The method of claim 3, further comprising:

monitoring the environment; and providing the image to a display located remotely from the environment.

5. A lighting system comprising:

a light source configured to illuminate an object at a first location in an environment; and a processor configured to detect a change in the environment including a change of location of the object from the first location to a second location, and to select a further light source for illumination of the object at the second location based on attributes of the illumination and availability and specifications of light sources, wherein the processor is to detect the change based on content analysis of a current image of the environment in comparison with a previous image of the environment.

6. The lighting system of claim 5, further comprising a camera configured to monitor the environment and provide an image of the environment to a display located remotely from the environment.

7. The lighting system of claim 6, further comprising a user interface configured to display the image of the environment.

* * * * *